US005297788A

United States Patent [19]

Thünker

[11] Patent Number: 5,297,788

[45] Date of Patent: Mar. 29, 1994

[54] GRIPPER CONTROL DEVICE IN A CHAIN DELIVERY OF A SHEET-FED PRINTING PRESS

[75] Inventor: Norbert Thünker, Hirschberg, Fed. Rep. of Germany

[73] Assignee: Heidelberger Druckmaschinen AG, Heidelberg, Fed. Rep. of Germany

[21] Appl. No.: 34,899

[22] Filed: Mar. 22, 1993

[30] Foreign Application Priority Data

Mar. 23, 1992 [DE] Fed. Rep. of Germany ..... 4209354

[51] Int. Cl.[5] ..... B65H 29/04

[52] U.S. Cl. ..... 271/204; 271/277; 198/470.1

[58] Field of Search ..... 271/82, 204, 206, 277; 294/116, 104; 198/803.9, 470.1

[56] References Cited

U.S. PATENT DOCUMENTS 3,109,644 11/1963 Reinartz ..... 271/206
3,610,579 10/1971 Jiruse ..... 271/206
3,703,281 5/1972 Liebert et al. .
4,205,606 6/1980 Jiruse ..... 271/206
4,582,316 4/1986 Wirz .

FOREIGN PATENT DOCUMENTS 1253529 5/1989 Canada .
2040670 3/1972 Fed. Rep. of Germany .
3002591 9/1980 Fed. Rep. of Germany .
3322342 9/1984 Fed. Rep. of Germany .
4108482 10/1991 Fed. Rep. of Germany .

*Primary Examiner*—H. Grant Skaggs
*Attorney, Agent, or Firm*—Herbert L. Lerner; Laurence A. Greenberg

[57] ABSTRACT

Gripper control device in a chain delivery of a sheet-fed printing press, wherein a cam segment has a control cam for a control roller provided on a gripper system and is adjustably disposed for opening a gripper of the gripper system as a sheet is delivered, the control cam being formed with a rectilinear on-running region aligned for rectilinear movement of the control roller in a given direction, includes an adjusting element operatively engageable with the cam segment for effecting a phase displacement of the gripper between a closed and an open condition thereof, the control cam of the cam segment, in an inactive basic position thereof, being aligned, with the on-running region thereof parallel to the given direction of rectilinear movement of the control roller for the gripper system, in an imaginary plane tangent to the control roller at a location on the circumference thereof most distal from the gripper of the gripper system, and a cam roller rotatably mounted on the cam segment, the adjusting element having a rotatably mounted control cam in operative engagement with the rotatably mounted cam roller.

7 Claims, 4 Drawing Sheets

GRIPPER CONTROL DEVICE IN A CHAIN DELIVERY OF A SHEET-FED PRINTING PRESS

The invention relates to a gripper control device in a chain delivery of a sheet-fed printing press, and more particularly, to such a device wherein a cam segment has a control cam for a control roller provided on a gripper system and is adjustably disposed for opening a gripper of the gripper system as a sheet is delivered, the control cam being formed with a rectilinear on-running region aligned for rectilinear movement of the control roller in a given direction.

Heretofore known from German Patent 30 02 591 is a gripper control device with only one control cam which is formed with an on-running or toe region and an off-running or heel region on a cam body. The cam body is swivelable by a coupler mechanism about a centerpoint of a circular arc-shaped gripper-carriage deflection path. An on-running or toe region of the cam obeys the law of a trochoid and effects a continuous or stepless transition to an approximately circular off-running or heel region. The on-running or toe region extends at an angle to a rectilinear gripper-chain centerline, so that a control roller for gripper movement, which is mounted on a roller lever in a gripper carriage, causes undesired noises and wear when it contacts the cam in the on-running or toe region.

Also known heretofore from German Patent 20 40 670 is an arrangement in which an on-running or toe cam and an off-running or heel cam for a control roller on a gripper for respectively opening and closing the gripper are provided on two different components so that they can be adjusted differently for effecting a phase displacement of the gripper movement. For this purpose, the component with the on-running or toe cam is formed rectilinearly on a coupler of a three-member crank mechanism having arms of equal length, but is likewise directed at a sharp angle to a rectilinear gripper-chain centerline. The increased expenditure with respect to a control cam on just one component is considerable.

From German Published Non-prosecuted Patent Application (DE-OS) 41 08 482, a gripper control device on a sheet-transporting swing gripper has become known heretofore, wherein the device has a circularly shaped cam segment which is adjustable by means of a four-bar linkage in order to reduce the transmission of vibrations which develop at a sheet-transfer location due to the acceleration of the sheet.

It is accordingly an object of the invention to provide a gripper control device in a chain delivery of a sheet-fed printing press which is adjustable for phase displacement, wherein the movement of the grippers is smoothly begun and smoothly ended, i.e., free of any jolting.

With the foregoing and other objects in view, there is provided, in accordance with the invention, a gripper control device in a chain delivery of a sheet-fed printing press, wherein a cam segment has a control cam for respective control rollers provided on gripper systems and is adjustably disposed for opening grippers of the gripper systems as sheets are delivered, the control cam being formed with a rectilinear on-running region aligned for rectilinear movement of the respective control rollers in a given direction, comprising an adjusting element operatively engageable with the cam segment for effecting a phase displacement of the grippers between a closed and an open condition thereof, the control cam of the cam segment, in an inactive basic position thereof, being aligned, with the on-running region thereof parallel to the given direction of rectilinear movement of the respective control rollers for the gripper systems, in an imaginary plane through apices of the respective control rollers, the apices being most distal from the respective grippers of the gripper systems, and a cam roller rotatably mounted on the cam segment, the adjusting element having a rotatably mounted control cam in operative engagement with the rotatably mounted cam roller.

In accordance with another aspect of the invention, there is further provided a gripper control device in a chain delivery of a sheet-fed printing press, wherein a cam segment has a control cam for a control roller provided on a gripper system and is adjustably disposed for opening a gripper of the gripper system as a sheet is delivered, the control cam being formed with a rectilinear on-running region aligned for rectilinear movement of the control roller in a given direction, comprising an adjusting element operatively engageable with the cam segment for effecting a phase displacement of the gripper between a closed and an open condition thereof, the control cam of the cam segment, in an inactive basic position thereof, being aligned, with the on-running region thereof parallel to the given direction of rectilinear movement of the control roller for the gripper system, in an imaginary plane tangent to the control roller at a location on the circumference thereof most distal from the gripper of the gripper system, and a cam roller rotatably mounted on the cam segment, the adjusting element having a rotatably mounted control cam in operative engagement with the rotatably mounted cam roller.

An advantage of the foregoing arrangements of the cam segment according to the invention is that, with the cam segment in the basic position, the control roller of the gripper system engages the cam segment without causing the gripper to be opened. In this basic position, the cam roller is smoothly run onto the control cam. The cam segment is moved by a cam transmission or drive mechanism in such a manner that the grippers are opened. A phase shift or displacement between the cam transmission or drive mechanism and the printing press permits adjustment of the instant of time at which the opening of the grippers occurs. Likewise, the control roller of the gripper smoothly lifts off or away from the cam guide in the off-running or heel region of the control cam of the cam segment. It should be noted that, both in the on-running or toe region of initial contact and also in the off-running or heel region of final contact between the gripper control roller and the control cam of the cam segment, a construction according to the invention calls for the contact angle in both the on-running or toe region and in the off-running or heel region of the control cam of the cam segment to tend towards zero.

In accordance with another feature of the invention, the control cam of the cam segment is also formed with an off-running region, both the on-running and the off-running regions of the control cam of the cam segment being substantially equidistant from a travel path corresponding to a locus of a center point of the respective control rollers, the adjusting element being phase-displaceably mounted and, with the control cam mounted thereon, being constrained to act upon the cam roller rotatably mounted on the cam segment.

In accordance with a further feature of the invention, the cam segment is spring-biased, by the cam roller mounted thereon, towards the rotatable control cam of the adjusting element and, through the cam segment, the control cam thereof is displaceable, over the entire effective length thereof, against the respective control rollers on the gripper systems in a direction transverse to the travel path.

In accordance with an added feature of the invention, the printing press has at least one frame-fixed part, and the device includes two guide levers by which the cam segment is movably mounted on the at least one frame-fixed part.

In accordance with an additional feature of the invention, the printing press has a frame-fixed part, and the cam segment has an articulated connection with the frame-fixed part at only one fixed location, any imaginary lines extending from the fixed location to a point on the control cam of the cam segment being other than perpendicular to the control cam of the cam segment.

In accordance with a concomitant feature of the invention, the control cam of the cam segment is also formed with an off-running region, and the cam roller mounted on the cam segment is mounted approximately at a point of transition of the control cam of the cam segment with the off-running region thereof.

Other features which are considered as characteristic for the invention are set forth in the appended claims.

Although the invention is illustrated and described herein as embodied in a gripper control device in a chain delivery of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
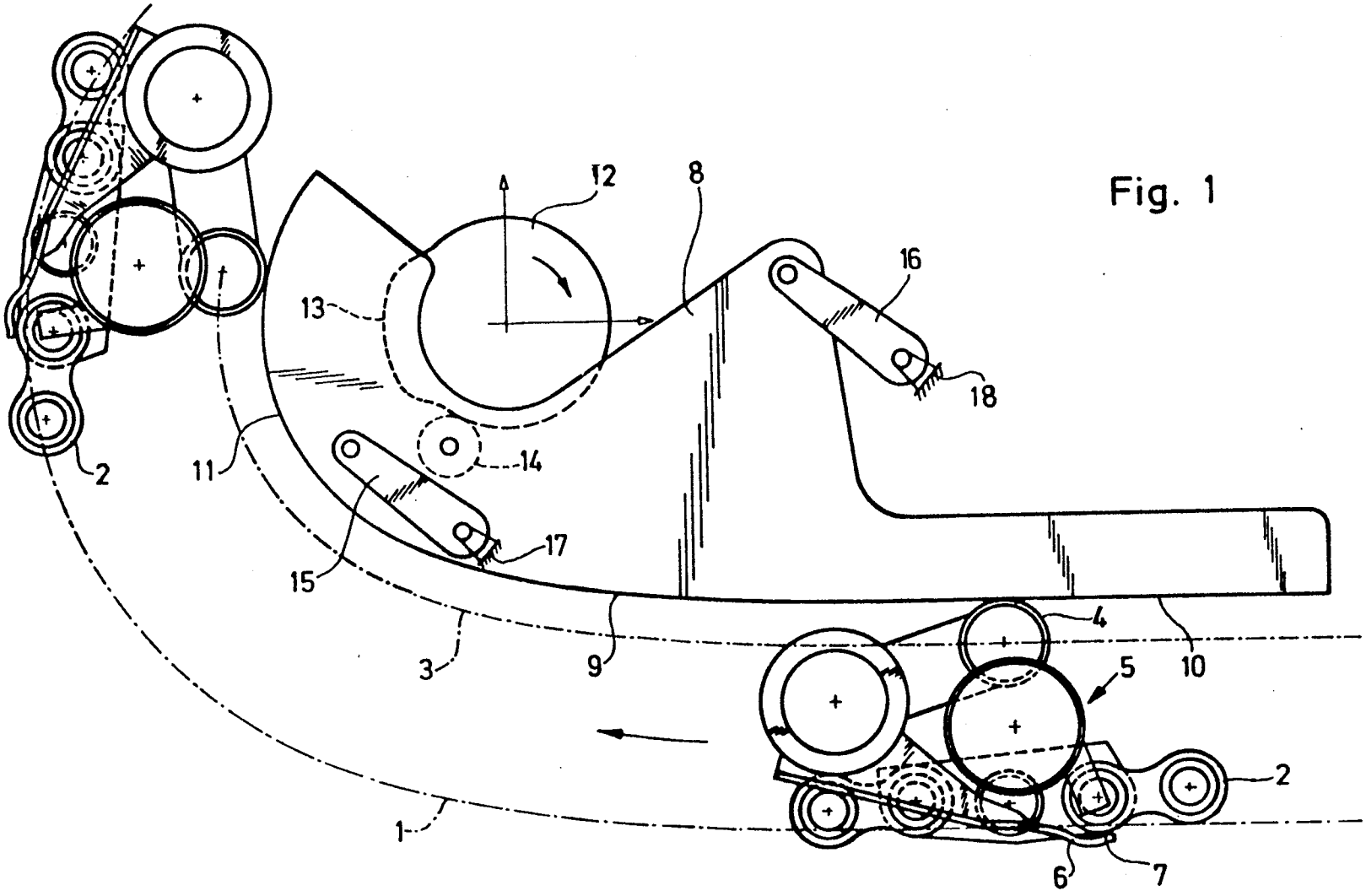
FIG. 1 is a side elevational view of an embodiment of the gripper control device according to the invention, in a basic position thereof.

Referring now to the figures of the drawings, it is noted that the dash-dot or phantom line 1 symbolically represents the path of gripper pads of gripper systems held on a gripper chain 2, the path making a transition at an outer deflection point into a substantially circular arcuate path. Parallel thereto, as represented by the dash-dot or phantom line 3, is a travel path of a center point of a control roller 4 on the gripper system 5, with which, in the illustrated embodiment, a gripper finger 6 cooperates with a gripper-finger pad or support 7. Generally, in such a gripper system 5, a plurality of grippers, mutually spaced apart adjacent one another, are supported on a gripper bar, which is articulatingly attached to two gripper chains 2, only one of which is shown in the figures the gripper chains 2 revolving parallel to one another and to the respective plane of the figures.

In order to control the movement of the gripper finger 6 for releasing the sheet in the sheet delivery, a cam segment 8 is provided, which is formed with a control cam 9 having an on-running or toe region 10 and an off-running or heel region 11 and acting upon the control roller 4. With the control cam 9 in a basic position thereof shown in FIG. 1, the control roller 4 engages the control cam 9 without causing the gripper finger 6 to lift off from the gripper-finger pad 7. The toe region 10 and the heel region 11 are of such construction that the control roller 4 runs up on the control cam 9 at a minimal angle, and ruins off the control cam 9 in a smooth and noiseless manner. A rotatably mounted adjusting element 12 provided for controlling the cam segment 8 has a control cam 13 on the circumference thereof, which acts upon a cam roller 14 freely rotatably mounted on the cam segment 8. The cam roller 14 and the control cam 13 are mutually biased or loaded towards one another by a non-illustrated spring. The cam segment 8 is displaced by rotating the adjusting element 12.

Figure 2:
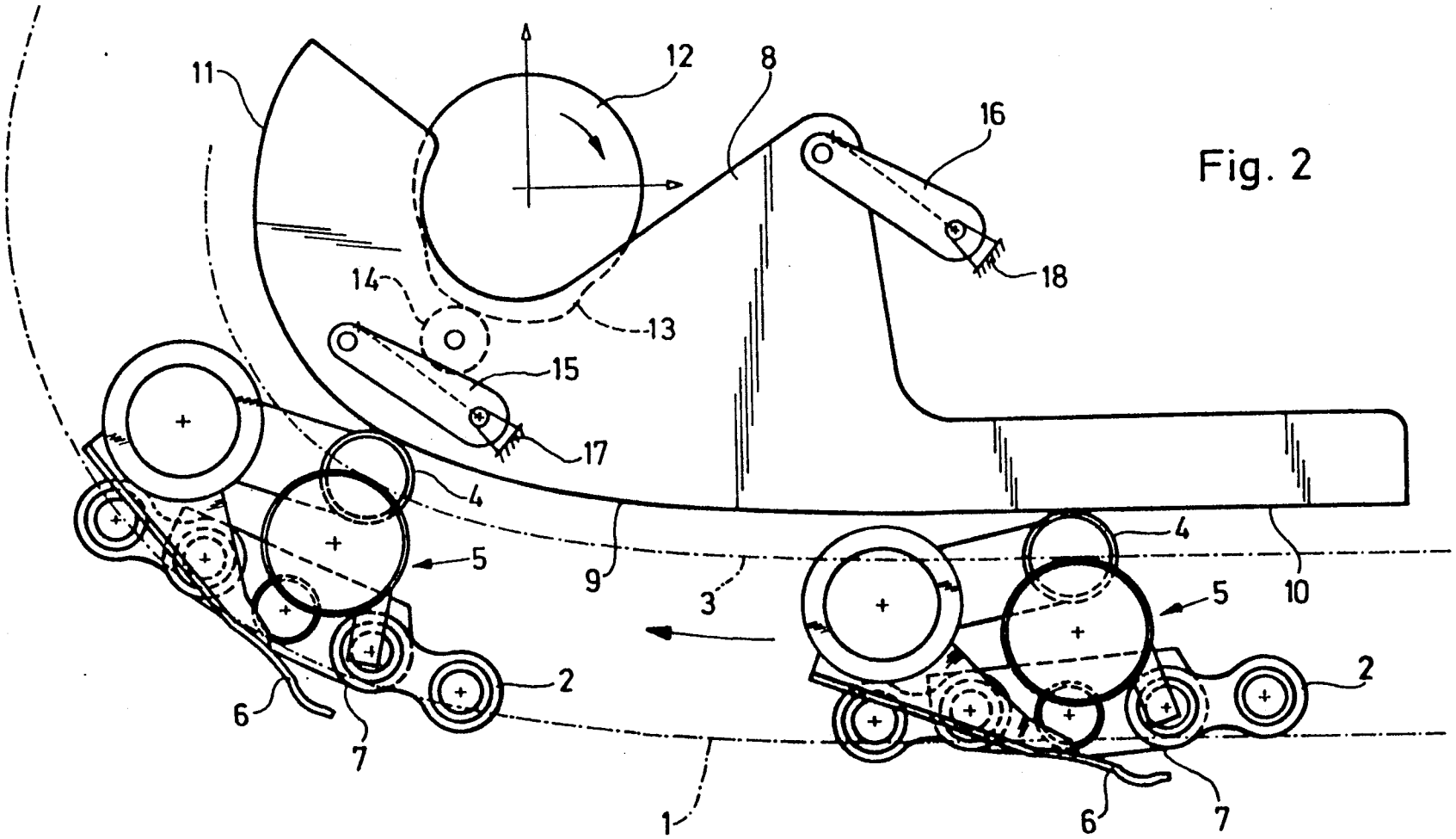
FIG. 2 is a view similar to that of FIG. 1, in another operating phase of the device, wherein a cam segment is adjusted for a gripper opening.

In the embodiment of the invention shown in FIGS. 1 and 2, the cam segment 8 is articulatingly attached by means of two guide levers 15 and 16 to fixed locations 17 and 18 on an otherwise non-illustrated frame or to components rigidly connected to the frame. An appropriate construction for such an articulated connection and its articulated attachment to fixed parts of the frame permits displacement, due to rotation of the adjusting element 12, of the cam segment 8 in a direction transverse to the travel path of the control roller 4 represented by the phantom line 3 in FIG. 1, so that, in a predetermined position, the control roller 4 lifts the gripper finger 6 off or away from the gripper-finger pad 7 and releases the sheet as it is being transported into the delivery. This displacement of the cam segment 8 is represented in FIG. 2. From the two illustrated gripper systems, it is readily apparent that the gripper openings may occur in every phase in which there is contact between the control roller 4 and the cam segment 8. For this purpose, a phase displacement of the adjusting element 12 must be effected, for example, by means of a non-illustrated transmission or drive.

Figure 3:
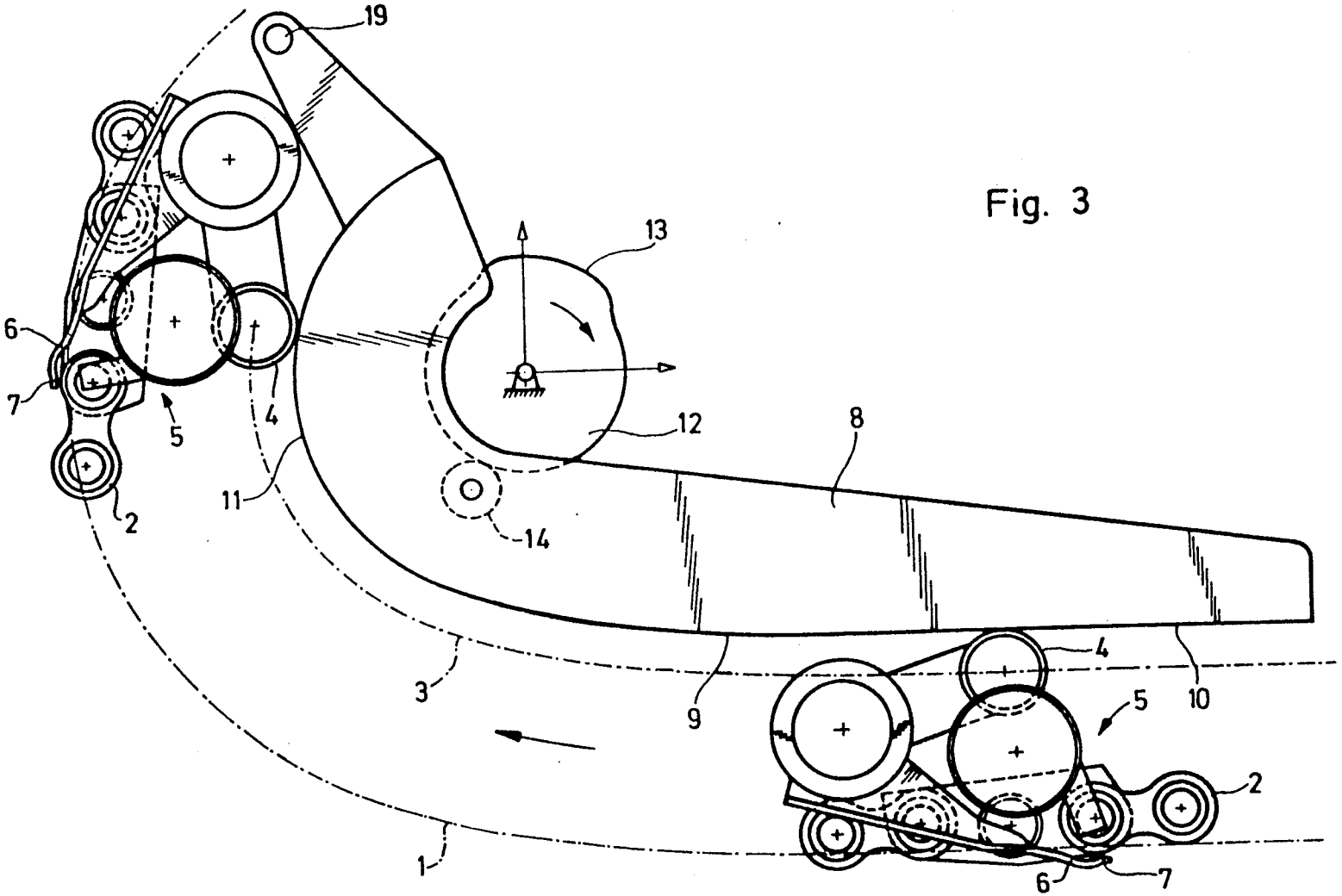
FIG. 3 is another view like those of FIGS. 1 and 2 of another embodiment of the device wherein a cam body thereof is in the basic position.
Figure 4:
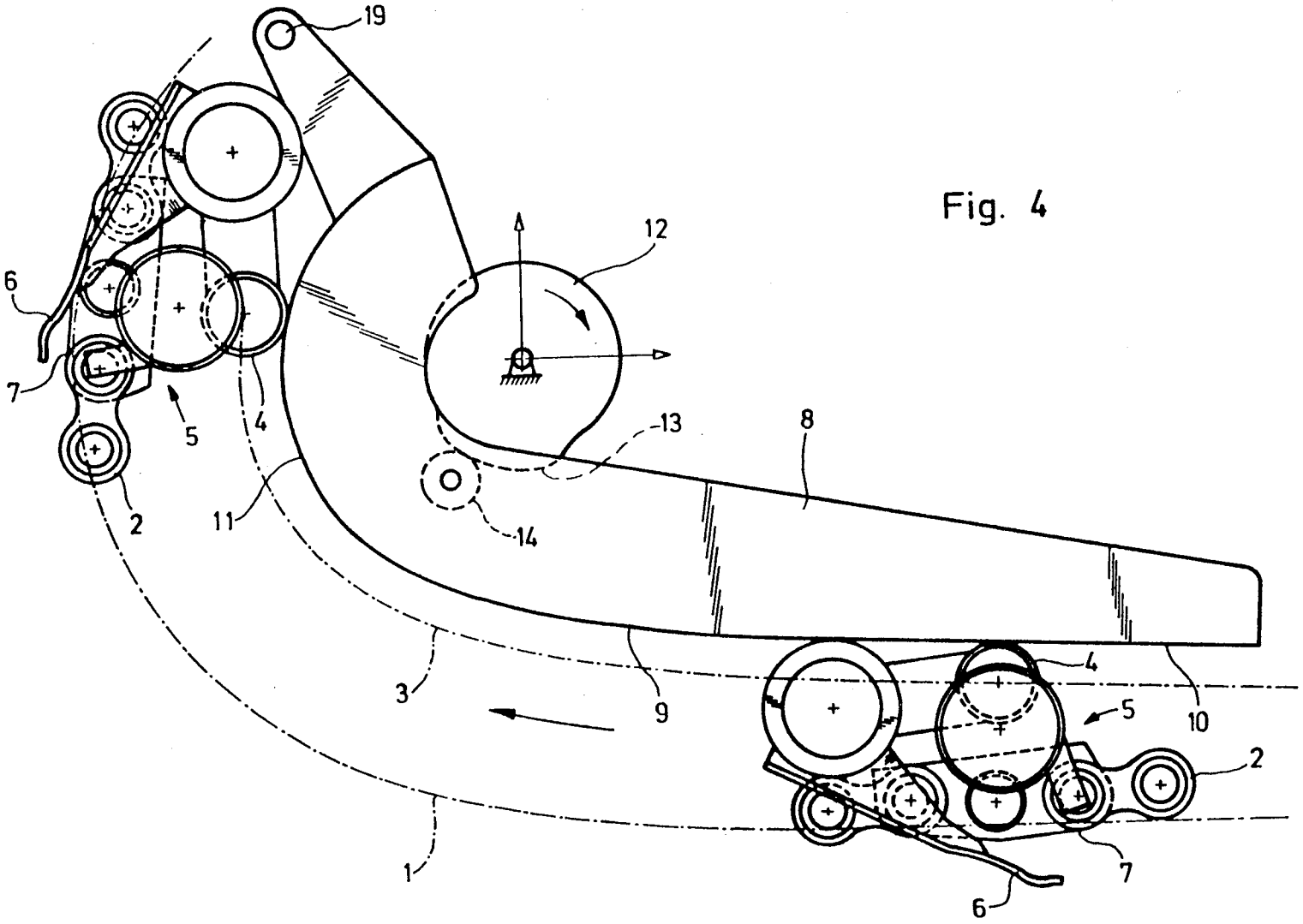
FIG. 4 is a view like that of FIG. 3, in another operating phase of the device wherein the cam body is adjusted for a gripper opening.

In the embodiment of the invention shown in FIGS. 3 and 4, the cam segment 8 is articulatingly connected only at one fixed location 19 to the aforementioned non-illustrated frame or to a component fixed to the frame. The fixed location 19 for the articulated attachment of the cam segment 8 is disposed relative to the control cam 9 so that an imaginary line extending from the fixed location 19 to any point on the cam 9, at least any point engageable by the control roller 4, is in no case perpendicular to the cam 9. Assurance is thereby provided that, as the cam segment 8 rotates from the basic phase position thereof shown in FIG. 3 into the phase position thereof shown in FIG. 4, each of the respective points on the control cam 9 effects a displacement of the cam roller 14 and, accordingly, an opening of the gripper. The fixed location 19 for the articulated attachment of the cam segment 8 lies on a vertical line which is disposed a distance horizontally past the journal or attachment location of the cam roller 14 on the cam segment 8, as viewed in the travel or running direction of the gripper chain 2 represented by the associated arrow located at the bottom of all of the figures, and is located vertically above the journal, the vertical distance from the journal of the cam roller 14 on the cam segment 8 to the level of the fixed location 19 being considerably greater than the aforementioned horizontal distance. The mutually parallel relationship of the on-running or toe region 10 of the control cam 9 and the rectilinear course of the centerpoint locus line 3 is maintained. FIG. 4 illustrates the displacement of the cam segment 8 with respect to the travel path of the control roller 4, which is effected by the adjusting element 12 with its control cam 13 through the intermediary of the control-cam roller 14, so that the control roller 4 on the gripper system 5 lifts the gripper finger 6 off or away from the gripper-finger pad or support 7.

In common with both illustrated embodiments of the invention, the control element 12 provided with the control cam 13 is disposed, in the side elevational view of the figures, approximately at a point of transition of the on-running or toe region 10 of the control cam 9 into the off-running or heel region 11 thereof, so that, in conjunction with the articulated attachment of the cam segment 8, a phase displacement is permitted wherein the toe region 10 and the heel region 11 retain their approximately parallel orientation with respect to the rectilinear course of the centerpoint locus line 3.

What is claimed:

1. Gripper control device in a chain delivery of a sheet-fed printing press, wherein a cam segment has a control cam for respective control rollers provided on gripper systems and is adjustably disposed for opening grippers of the gripper systems as sheets are delivered, the control cam being formed with a rectilinear on-running region aligned for rectilinear movement of the respective control rollers in a given direction, comprising an adjusting element operatively engageable with the cam segment for effecting a phase displacement of the grippers between a closed and an open condition thereof, the control cam of the cam segment, in an inactive basic position thereof, being aligned, with the on-running region thereof parallel to the given direction of rectilinear movement of the respective control rollers for the gripper systems, in an imaginary plane through apices of the respective control rollers, said apices being most distal from the respective grippers of the gripper systems, and a cam roller rotatably mounted on the cam segment, said adjusting element having a rotatably mounted control cam in operative engagement with said rotatably mounted cam roller.

2. Device according to claim 1, wherein the control cam of the cam segment is also formed with an off-running region, both the on-running and said off-running regions of the control cam of the cam segment being substantially equidistant from a travel path corresponding to a locus of a center point of the respective control rollers, said adjusting element being phase-displaceably mounted and, with said control cam mounted thereon, being constrained to act upon said cam roller rotatably mounted on the cam segment.

3. Device according to claim 2, wherein the cam segment is spring-biased, by said cam roller mounted thereon, towards said rotatable control cam of the adjusting element and, through the cam segment, the control cam thereof is displaceable, over the entire effective length thereof, against the respective control rollers on the gripper systems in a direction transverse to said travel path.

4. Device according to claim 1, wherein the printing press has at least one frame-fixed part, and including two guide levers by which the cam segment is movably mounted on the at least one frame-fixed part.

5. Device according to claim 1, wherein the printing press has a frame-fixed part, the cam segment having an articulated connection with the frame-fixed part at only one fixed location, any imaginary lines extending from said fixed location to a point on the control cam of the cam segment being other than perpendicular to the control cam of the cam segment.

6. Device according to claim 1, wherein the control cam of the cam segment is also formed with an off-running region, and wherein said cam roller mounted on the cam segment is mounted approximately at a point of transition of the control cam of the cam segment with said off-running region thereof.

7. Gripper control device in a chain delivery of a sheet-fed printing press, wherein a cam segment has a control cam for a control roller provided on a gripper system and is adjustably disposed for opening a gripper of the gripper system as a sheet is delivered, the control cam being formed with a rectilinear on-running region aligned for rectilinear movement of the control roller in a given direction, comprising an adjusting element operatively engageable with the cam segment for effecting a phase displacement of the gripper between a closed and an open condition thereof, the control cam of the cam segment, in an inactive basic position thereof, being aligned, with the on-running region thereof parallel to the given direction of rectilinear movement of the control roller for the gripper system, in an imaginary plane tangent to the control roller at a location on the circumference thereof most distal from the gripper of the gripper system, and a cam roller rotatably mounted on the cam segment, said adjusting element having a rotatably mounted control cam in operative engagement with said rotatably mounted, cam roller.

* * * * *